US007423381B2

(12) United States Patent
Hanna

(10) Patent No.: US 7,423,381 B2
(45) Date of Patent: Sep. 9, 2008

(54) PARTICLE ACCELERATOR AND METHODS THEREFOR

(76) Inventor: Samy M. Hanna, 30 Gold Creek Ct., Danville, CA (US) 94506

( * ) Notice: Subject to any disclaimer, the term of this patent is extended or adjusted under 35 U.S.C. 154(b) by 411 days.

(21) Appl. No.: 11/287,976

(22) Filed: Nov. 27, 2005

(65) Prior Publication Data

US 2007/0120508 A1 May 31, 2007

(51) Int. Cl.
*H05H 9/04* (2006.01)

(52) U.S. Cl. ..... 315/5.41; 315/5.42; 315/500; 315/505

(58) Field of Classification Search ..... 315/5.41, 315/5.42, 5.43, 500, 501, 505, 506, 507
See application file for complete search history.

(56) References Cited

U.S. PATENT DOCUMENTS

| | | | | |
|---|---|---|---|---|
| 4,988,919 | A | 1/1991 | Tanabe et al. | |
| 5,039,910 | A * | 8/1991 | Moriguchi et al. | 315/5.41 |
| 5,381,072 | A | 1/1995 | Tanabe | |
| 6,316,876 | B1 | 11/2001 | Tanabe | |
| 6,483,263 | B1 | 11/2002 | Hanna et al. | |
| 6,498,444 | B1 | 12/2002 | Hanna et al. | |
| 6,674,254 | B2 | 1/2004 | Hanna et al. | |
| 2005/0057198 | A1 | 3/2005 | Hanna | |

OTHER PUBLICATIONS

Rosenberg, U., Amari, S., Bornemann, J., "Mixed-Resonance Compact in-line Pseudo-Elliptic Filters", 2003 IEEE MTT-S Int. Microwave Symp. Dig., pp. 479-482, 2003.
Wangler, T. P., "Principles of RF Linear Accelerators", John Wiley & Sons, Inc., ISBN 0-471-16814-9, pp. 88-129, 1998.
Scharf, W. H., "Biomedical Particle Accelerators", American Institute of Physics, ISBN 1-56396-089-3, pp. 1-91,1994.
Karzmark, C.J., Nunan, C.S., Tanabe, E., "Medical Electron Accelerator", McGraw-Hill, Inc., ISBN 0-07-105410-3, pp. 49-87, 1993.
Bornemann, J., Vahldieck, R., "Comparative Study of $TE^{x}_{mn}$ Versus $TE_{mn}$-$TM_{mn}$ Mode Discontinuity Modeling", in 1990 IEEE MTT-S Int. Microwave Symp. Dig., pp. 713-716, 1990.

* cited by examiner

*Primary Examiner*—David Hung Vu
(74) *Attorney, Agent, or Firm*—Kang Lim

(57) ABSTRACT

Standing-wave linear accelerators (linac) having a plurality of accelerating cavities and which do not have any auxiliary cavities are provided. Such linacs are useful for industrial applications such as radiography, cargo inspection and food sterilization, and also medical applications such as radiation therapy and imaging. In one embodiment, the linac includes an electron gun for generating an electron beam, and a plurality of accelerating cavities which accelerates the electron beam by applying electromagnetic fields generated by a microwave source. At least two adjacent accelerating cavities of the plurality of accelerating cavities are coupled together by at least one resonant iris. The electromagnetic fields resonate through the plurality of accelerating cavities and the at least one resonant iris.

20 Claims, 16 Drawing Sheets

PARTICLE ACCELERATOR AND METHODS THEREFOR

BACKGROUND OF THE INVENTION

The present invention relates to particle accelerators. More particularly, the present invention relates to cost effective particle accelerators for applications including industrial applications such as radiography, cargo inspection and food sterilization, and also medical applications such as radiation therapy and imaging.

Particle accelerators operate by generating charged particles having a particular energy depending on the application. One exemplary particle accelerator is the standing-wave (SW) electron linear accelerator (linac) used in medical and industrial applications. FIG. 1A shows a simplified functional representation of a linac 100 which receives electrons from an electron gun 112. The electrons are accelerated to produce a high-energy electron beam 114 along an axial bore hole 140. Beam 114 is focused and accelerated in a series of accelerating cavities 120*a*, 120*b* . . . 120*n* by forces exerted on the electrons by microwave fields which are fed from an external microwave source 116 such as a klystron or a magnetron. The microwave fields resonate inside accelerating cavities 120*a*, 120*b* . . . 120*n* and also resonate inside auxiliary cavities 113*a*, 113*b* . . . 113*m*.

For example, in some medical applications, the high-energy beam 114 produced by the linac 100 may be applied directly to a cancer therapy volume on a patient, or beam 114 may be used to generate photons (x-rays) 130 by colliding with a suitable target 122 such as tungsten or gold. The resulting x-ray beam 130 may be used to image cancerous tumors and/or to destroy the cancerous cells within the tumors by its ionizing effect (see Section 1.2, pages 29-32 of "Biomedical Particle Accelerators" by W. H. Scharf, AIP Press, 1994, ISBN 1-56396-089-3).

FIG. 1B illustrates the phases of the microwave fields along the accelerating cavities 120*a*, 120*b* . . . 120*n* and the auxiliary cavities 113*a*, 113*b* . . . 113*m*. SW linacs capable of generating electron beams with an energy level of up to 25 MeV require approximately 50 resonant cavities for stable operation. In addition, in order to accelerate the electrons efficiently along an axial bore 140, the microwave fields in the accelerating cavities 120*a*, 120*b* . . . 120*n* should have a phase difference of 180 degrees from one accelerating cavity to the adjacent accelerating cavity, e.g., from cavity 120*a* to cavity 120*b*.

FIG. 2 is a graph 200 showing the different resonant frequency modes for an exemplary approximate model of a linac constituting of 51 resonant cavities with attendant frequency mode separation or spacing 251, 255 between adjacent modes. Around the π-mode 245, the mode frequency separation 255 is relatively small, and hence not ideal for stable operation of this exemplary linac. For this reason, the mode at the center of the graph, mode 241, also known as the π/2-mode, is generally the preferred mode of operation. This is because the π/2-mode provides the maximum frequency spacing, as measured along the vertical frequency axis, between adjacent modes, i.e. at mode frequency separation 251. Operation at the π/2-mode is conventionally realized through the use of a bi-periodic arrangement to ensure that the phase difference of the microwave fields is 180 degrees between adjacent accelerating cavities for efficient electron beam acceleration (see pages 76-82 of "Medical Electron Accelerators" by T. J. Karzmark, et al., McGraw-Hill, Inc., 1993, ISBN 0-07-105410-3) (see also pages 113-117 of T. P. Wangler, "Principles of RF Linear Accelerators", John Wiley & Sons, Inc., ISBN 0-471-16814-9).

Referring back to FIG. 1A, in addition to the set of accelerating cavities 120*a*, 120*b* . . . 120*n*, a conventional bi-periodic structure for linac 100 requires an additional corresponding set of auxiliary cavities 113*a*, 113*b* . . . 113*m*. Each auxiliary cavity couples the microwave power to an adjacent pair of accelerating cavities through a corresponding pair of coupling irises. The number of frequency modes in a bi-periodic linac is equal to the number of the combined resonant cavities, i.e., the total number of the accelerating cavities 120*a*, 120*b* . . . 120*n* and the auxiliary cavities 113*a*, 113*b* . . . 113*m*. For efficient operation of the linac 100, all the constituent resonant cavities should resonate at specific frequencies to ensure synchrony between the electrons being accelerated in the accelerating cavities and the electromagnetic field oscillating in all the resonant cavities.

One conventional SW bi-periodic linac configuration is the side-coupled SW linac 300, shown in FIG. 3A, wherein the auxiliary cavities 313*a*, 313*b* . . . 313*m* are placed on the sides of the accelerating cavities 320*a*, 320*b*, . . . 320*n*, away from the axis of beam 314. Auxiliary cavity 313*a* is coupled to the adjacent accelerating cavities 320*a*, 320*b* through a corresponding pair of coupling irises 317*a*, 317*b*. Similarly, auxiliary cavity 313*b* is coupled to the adjacent accelerating cavity 320*b* through a coupling iris 318*b*. FIG. 3B is a cross-sectional view of linac 300 illustrating accelerating cavity 320*a*, auxiliary cavities 313*a*, 313*b* and coupling irises 317*a*, 318*b*.

Another conventional SW bi-periodic linac configuration is the on-axis SW linac 400 shown in FIG. 4A, wherein the auxiliary cavities 413*a*, 413*b* . . . 413*m* are placed along the axis of beam 414. The auxiliary cavity 413*a* is coupled to the adjacent accelerating cavity 420*a* through a pair of irises 416*a*, 418*a*. Auxiliary cavity 413*a* is also coupled to adjacent accelerating cavity 420*b* through a pair of irises 417*a*, 419*a*. FIG. 4B is a cross-sectional view of linac 400 illustrating accelerating cavity 420*b*, auxiliary cavity 413*b* and coupling irises 416*b*, 418*b*.

In one conventional method of manufacturing linacs, e.g., for linacs 100, 300, 400, constituent sub-assembly components are stacked and brazed together to ensure vacuum tight joints. These joints are also required to provide continuity of the linac inner walls hosting the microwave current associated with the electromagnetic fields hosted in the cavities. The brazing process involves the use of alloy brazing foils that are inserted into the joints between adjacent cavities. A brazing furnace provides heat to melt the brazing foils that solidify later to form the vacuum tight joints. During brazing, some of the molten brazing alloy can make its way inside the cavities, resulting in a change in the volume of the cavity(s) which in turn can change the resonant frequency characteristics of the linac.

For this reason, it is a common practice to manually tune the individual cavities after the brazing step in order to bring the frequencies of individual cavities to their nominal frequencies. This is usually done by a skilled tuning technician who has to affix the linac on a fixture, perform a series of measurements, and modify the cavities as needed by deforming the physical structure of each cavity until the desired frequency is achieved. This process is a time consuming and substantially increases the manufacturing cost of the linacs.

Hence there is a need for improved linacs which are less costly to manufacture, more efficient to operate and more compact in size.

SUMMARY OF THE INVENTION

To achieve the foregoing and in accordance with the present invention, linear accelerators (linac) having a plurality of accelerating cavities and which do not have any auxiliary cavities are provided. Such linacs are useful for industrial applications such as radiography, cargo inspection and food sterilization, and also for medical applications such as radiation therapy and imaging.

In one embodiment, a standing-wave linear accelerator includes an electron gun for generating an electron beam, and a plurality of accelerating cavities which accelerates the electron beam by applying electromagnetic fields generated by a microwave source. At least two adjacent accelerating cavities of the plurality of accelerating cavities are coupled together by at least one coupling iris. The electromagnetic fields resonate through the plurality of accelerating cavities, and the operating frequency of the electromagnetic fields is selected so that the linear accelerator is operating at a π-mode or a mode close to the π-mode.

In another embodiment, the frequency of the electromagnetic fields is selected so that the linear accelerator is operating at a π/2-mode or a mode close to the π/2-mode. This more stable mode of operation is possible because at least two adjacent accelerating cavities of the plurality of accelerating cavities are coupled together by at least one coupling iris which also functions as a resonator for the electromagnetic fields.

In some embodiments, the linear accelerator also includes a target made from a suitable material such as tungsten or gold. The target produces x-rays when the electron beam collides with the target.

Note that the various features of the present invention can be practiced alone or in combination. These and other features of the present invention will be described in more detail below in the detailed description of the invention and in conjunction with the following figures.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention. The features and advantages of the present invention may be better understood with reference to the drawings and discussions that follow.

To facilitate discussion, FIGS. 5A, 5B, 6A-6C, 7A, 7B, 8A, 8B, and 9A-9E include block diagrams, graphs and sectional views which illustrate several embodiments of the linear accelerators of the present invention.

Historically, the prevailing approach to the design and manufacture of industrial and medical linear accelerators resulted in the commercialization of standing-wave (SW) bi-periodic linear accelerators (linacs). With the recent advent of more sensitive imaging technology and more accurate targeting technology, lower-energy compact linacs in the 4 to 8 MeV range are now in greater demand. FIG. 5A is an approximate graphical model showing the frequency mode spacing for an exemplary bi-periodic linac with 13 resonant cavities. A typical 13 resonant cavity bi-periodic linac may have 7 accelerating cavities and 6 auxiliary cavities.

Figure 1A:
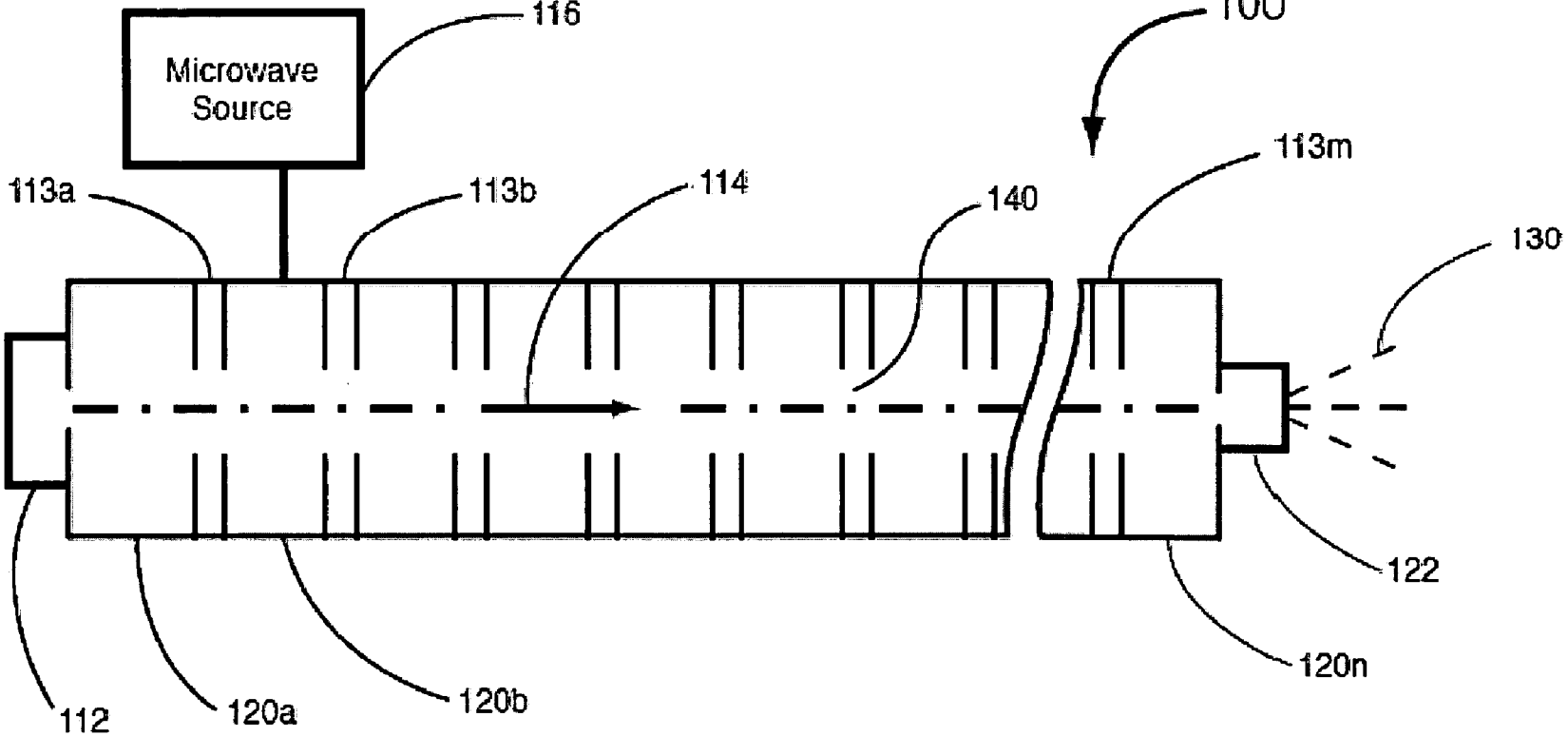
FIG 1A PRIOR ART
FIG. 1A shows a simplified functional representation of a bi-periodic linear accelerator.
Figure 1B:
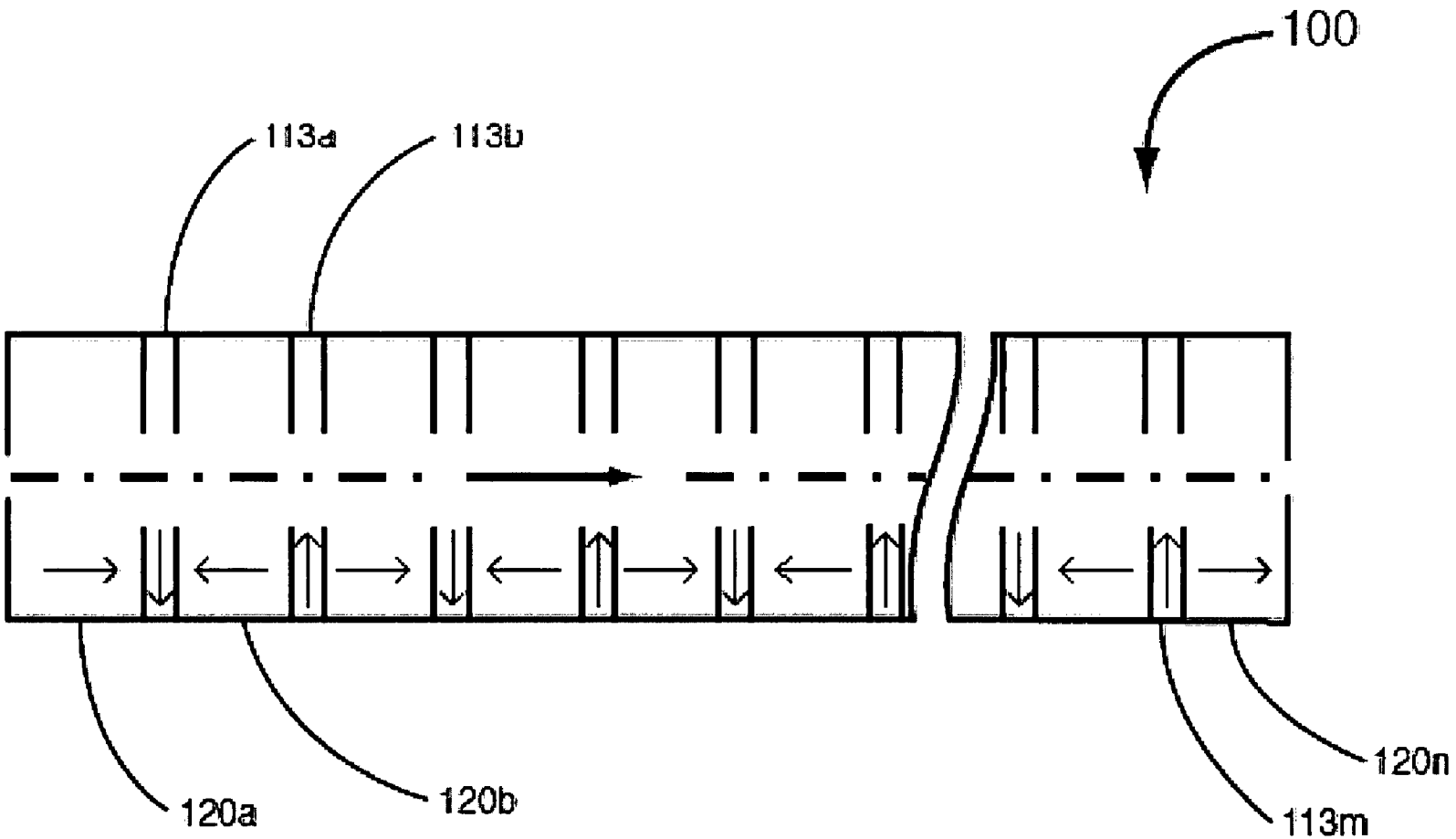
FIG 1B PRIOR ART
FIG. 1B illustrates the phases of the microwave fields along the accelerating cavities and the auxiliary cavities of the linear accelerator of FIG. 1A.
Figure 2:
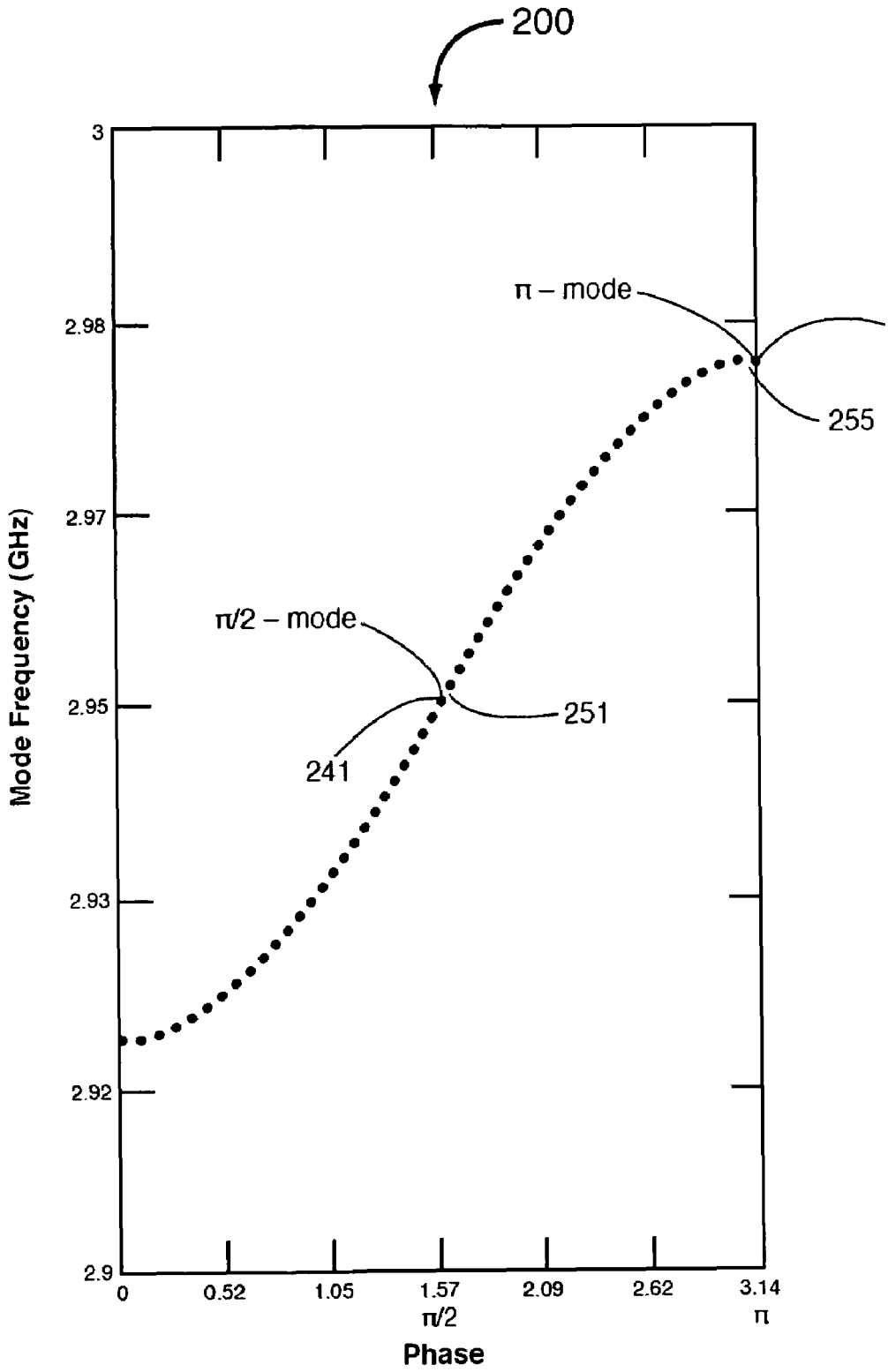
FIG 2 PRIOR ART
FIG. 2 is a graphical model showing the different resonant frequency modes for an exemplary linear accelerator constituting of 51 resonant cavities.
Figure 3A:
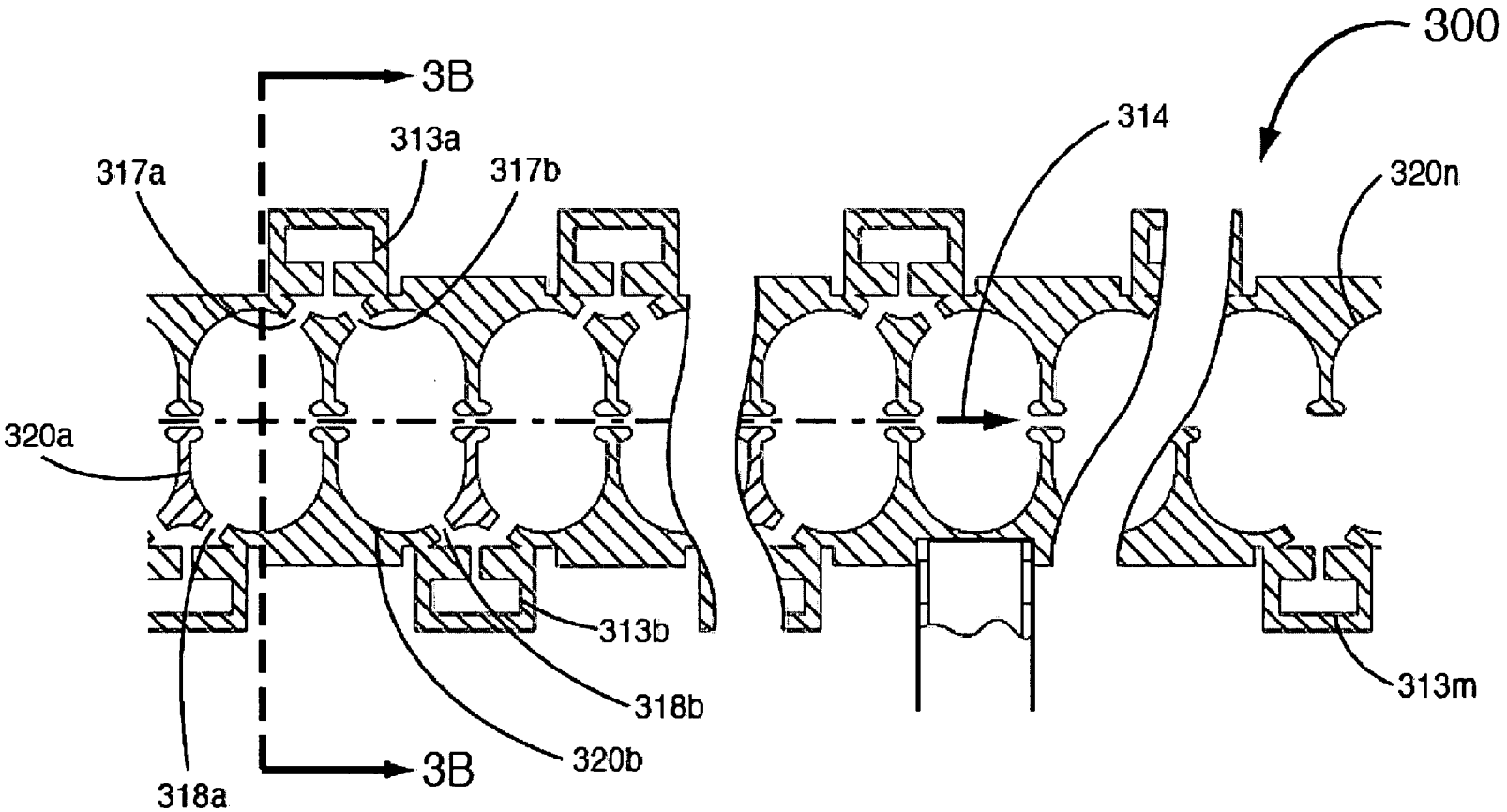
FIG 3A PRIOR ART
FIGS. 3A and 3B illustrate a conventional standing-wave bi-periodic linac having side-coupled auxiliary cavities.
Figure 3B:
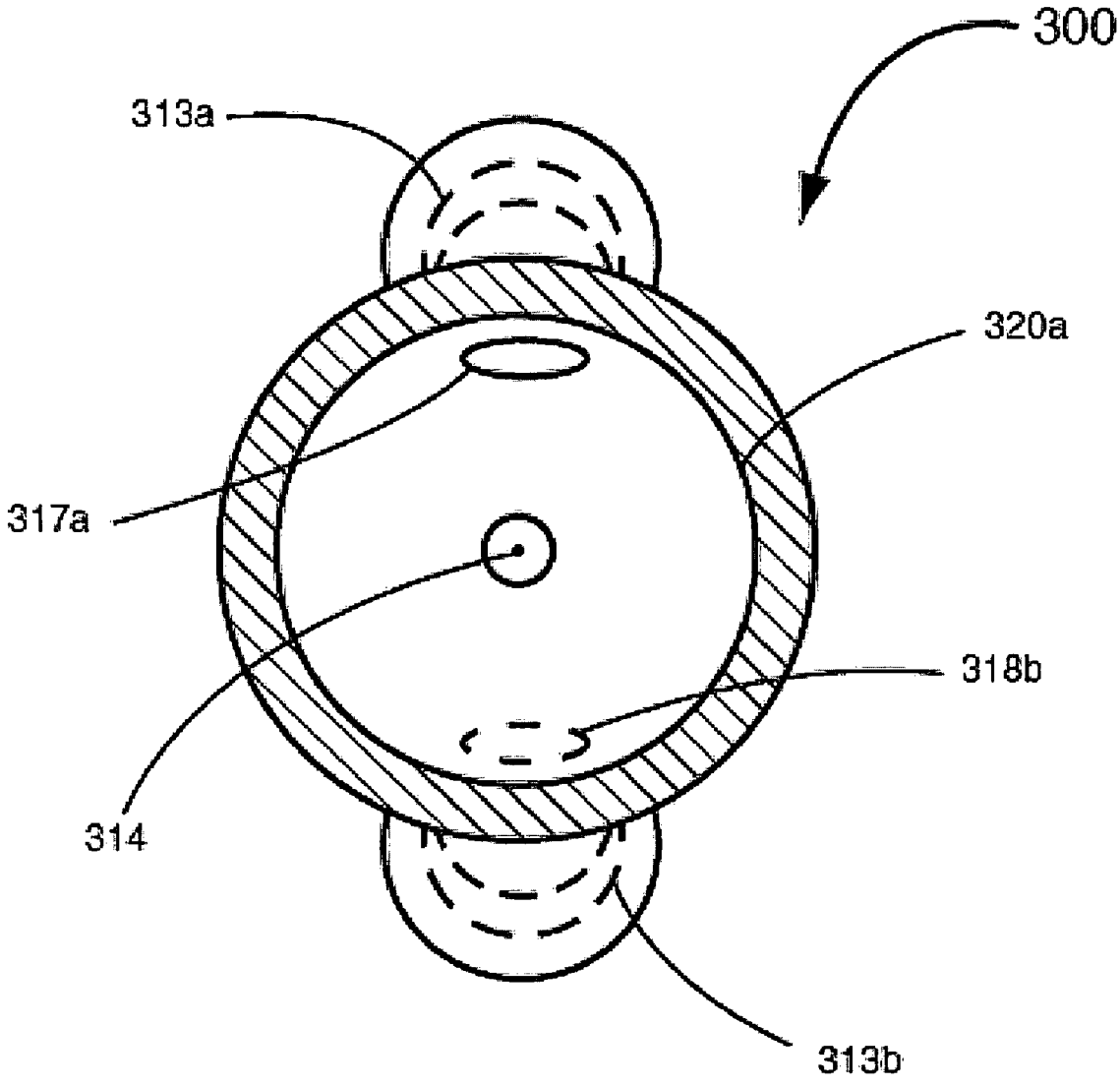
FIG 3B PRIOR ART
Figure 4A:
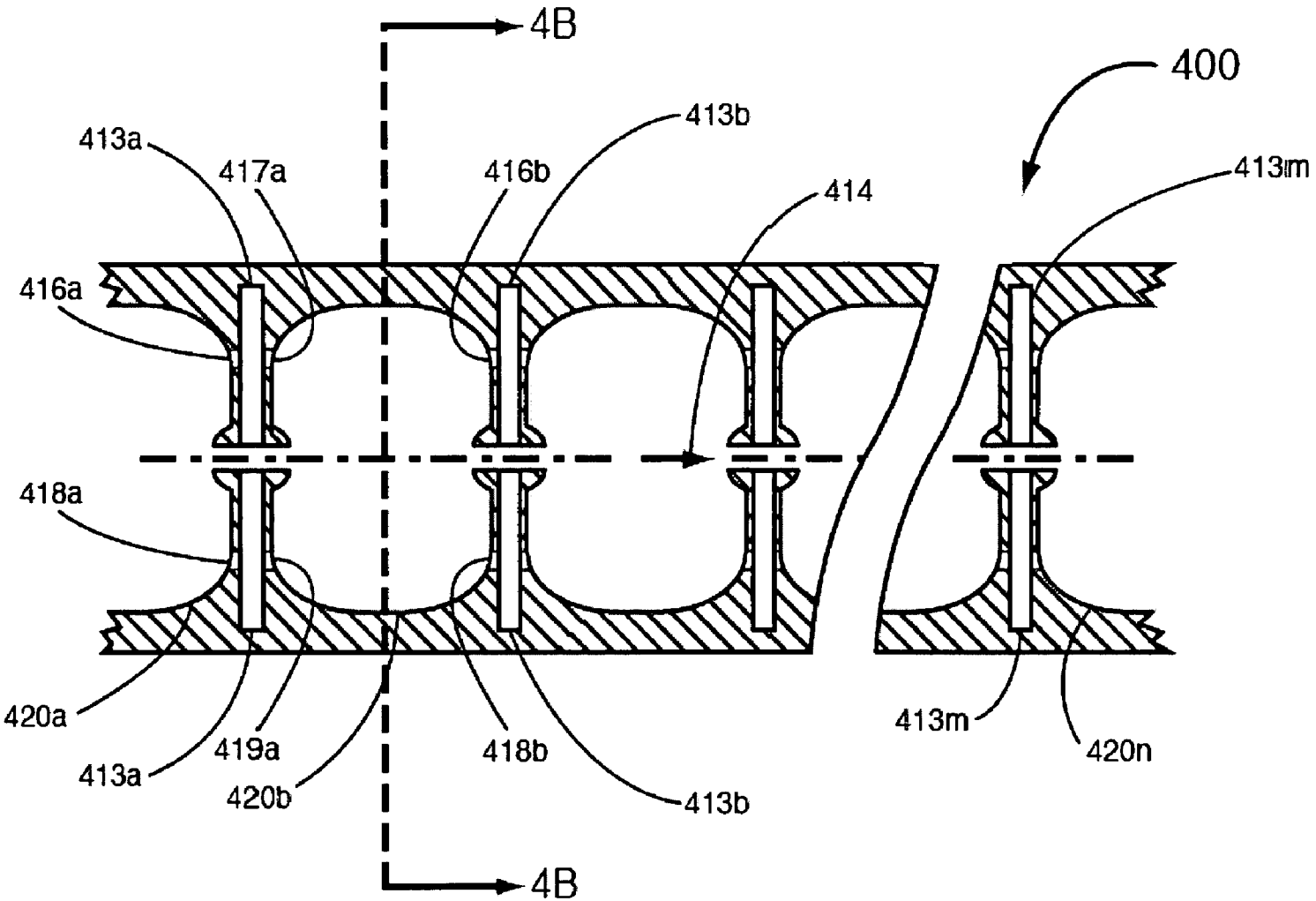
FIG 4A PRIOR ART
FIGS. 4A and 4B illustrate a conventional standing-wave bi-periodic linac having on-axis auxiliary cavities.
Figure 4B:
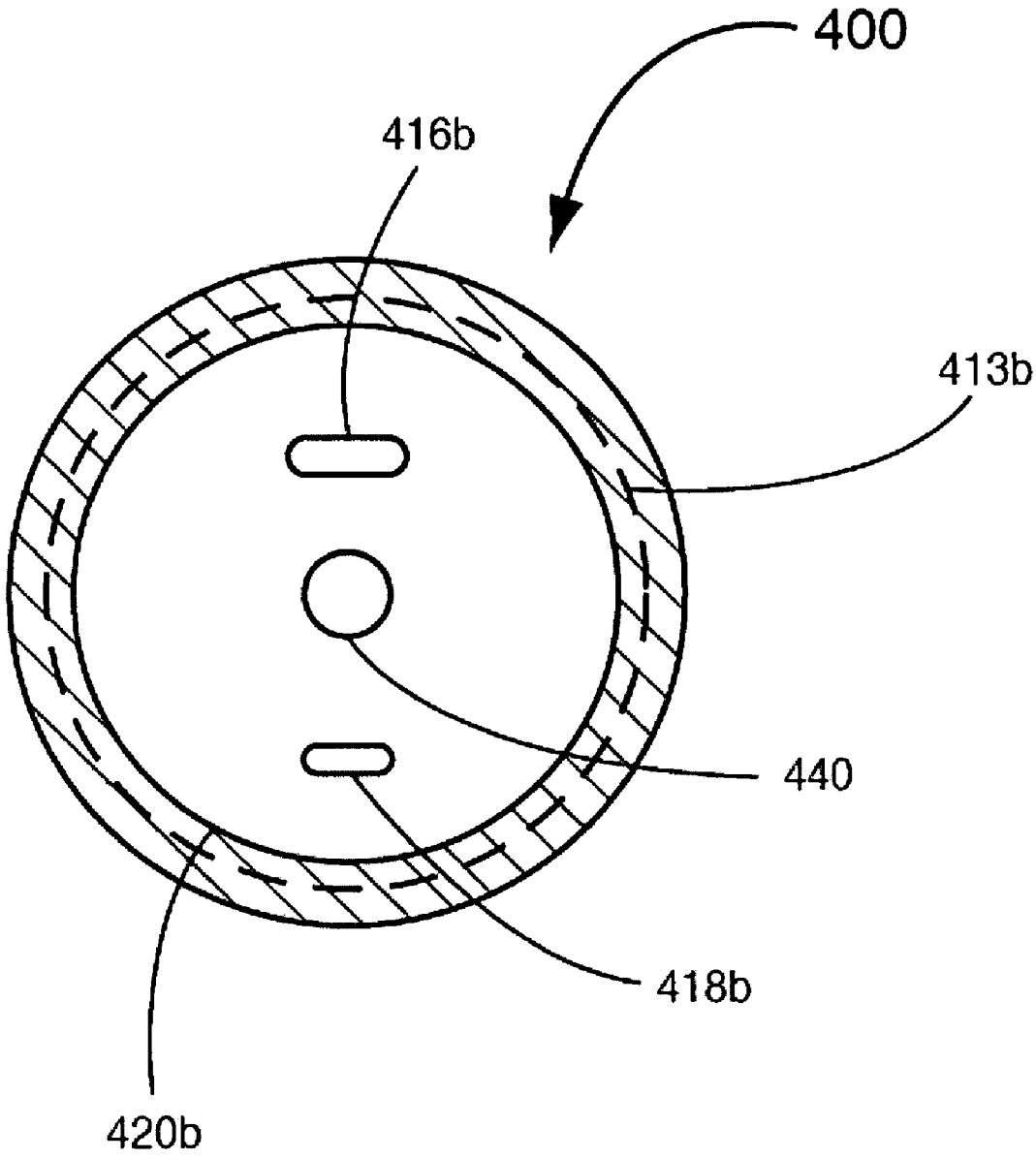
FIG 4B PRIOR ART
Figure 5B:
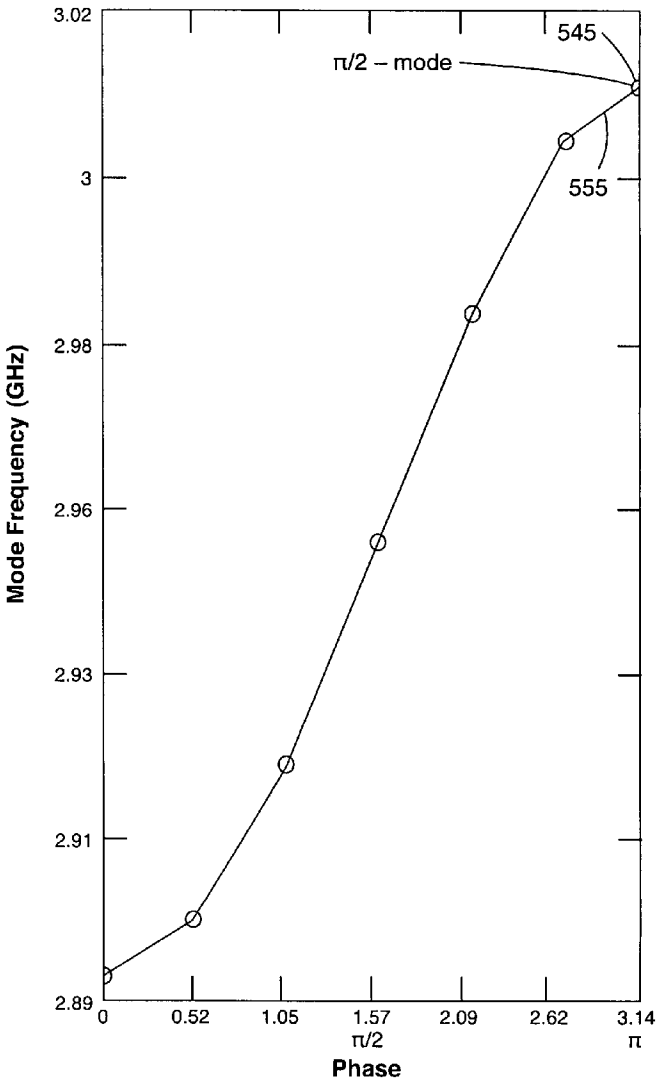
FIG. 5B is a graphical model illustrating the approximate frequency mode spacing for a lower-energy linac with 7 resonant cavities.
Figure 5A:
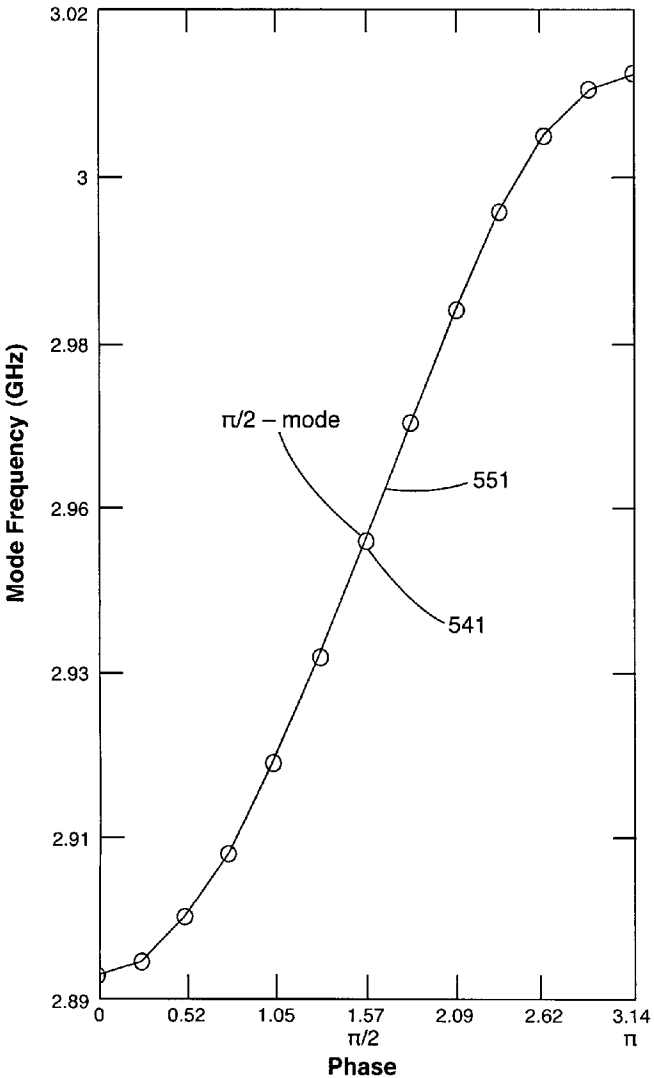
FIG. 5A is an approximate graphical model showing the frequency mode spacing for an exemplary bi-periodic linac with 13 resonant cavities.

In contrast, the graphical model of FIG. 5B illustrates the approximate frequency mode spacing for a lower-energy linac with 7 resonant cavities. Unlike the relatively narrower frequency mode spacing of the higher-energy linacs as illustrated by FIG. 2 above, because the lower-energy linacs have fewer resonant cavities and hence fewer frequency modes, the frequency mode spacing as measured in the vertical frequency axis, e.g., mode spacing 555 of FIG. 5B, of lower-energy linacs operating at the π-mode 545 is sufficient for stable operation because the stability of such lower-energy linacs is not seriously degraded. Note that the frequency mode spacing 555 (see FIG. 5B) at the π-mode 545 is comparable with the frequency mode spacing 551 (see FIG. 5A) at the π/2-mode 541 for a bi-periodic linac with 13 resonant cavities.

Figure 6B:
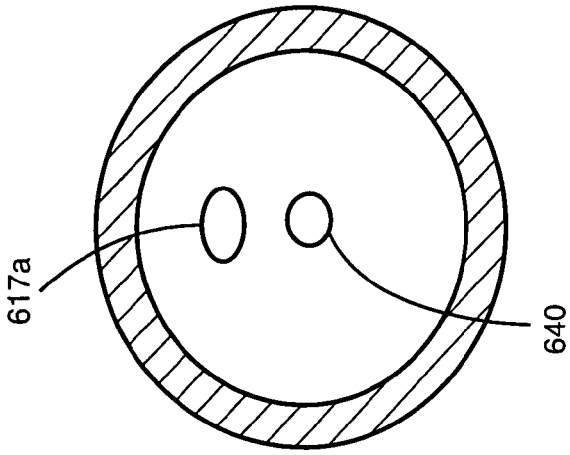
FIGS. 6A and 6B show one embodiment of a lower-energy π-mode linear accelerator 600 in accordance with the present invention.
Figure 6A:
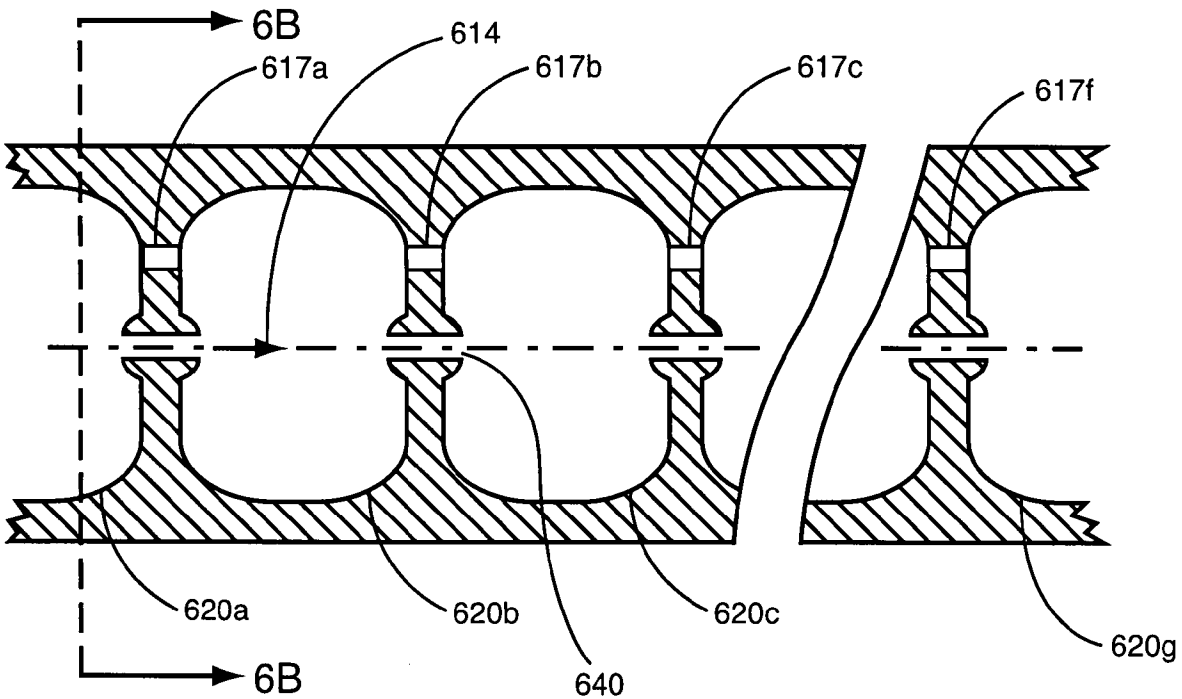

In accordance with the present invention, FIGS. 6A and 6B show one embodiment of a lower-energy π-mode linac 600 which includes accelerating cavities 620*a*, 620*b*, 620*c* . . . 620*g* and does not include any auxiliary cavities. Linac 600 also includes a corresponding set of irises 617*a*, 617*b*, 617*c* . . . 617*f* which provides improved coupling for the microwave power between accelerating cavities 620*a*, 620*b*,

620*c* . . . 620*g*, thereby allowing most of the microwave power to bypass axial bore 640. For example, adjacent accelerating cavities 620*a*, 620*b* are coupled to each other via iris 617*a*, while adjacent accelerating cavities 620*b*, 620*c* are coupled to each other via iris 617*b*. Hence, irises 617*a*, 617*b*, 617*c* . . . 617*f* facilitate the overall flow of the microwave power thereby enabling linac 600 to operate efficiently in the π-mode.

The simplified configuration of linac 600 is particularly useful for linacs producing electron beams with output energies less than 10 MeV where the total number of resonant cavities can be about 10 or less, thereby permitting stable operation in the π-mode. As a result, by eliminating the need for auxiliary cavities in linac 600, the total number of resonant cavities is equal to the number of accelerating cavities. Hence, the total number of resonant cavities in exemplary linac 600 is about one-half of that needed in the conventional bi-periodic linacs of comparable energy output described above.

Figure 6C:
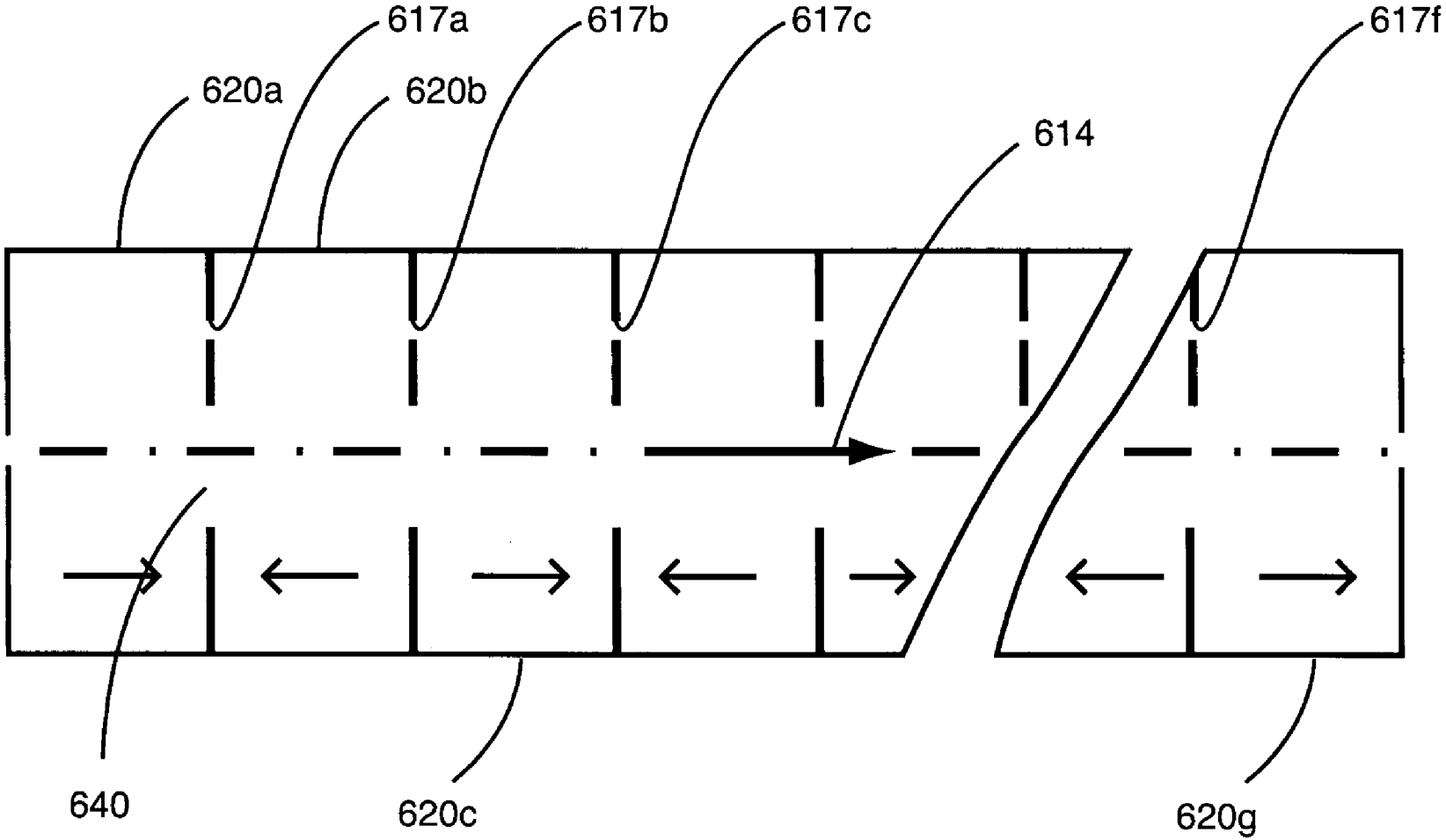
FIG. 6C is a block diagram showing the phases of the microwave fields along the accelerating cavities of linear accelerator of FIG. 6A.

FIG. 6C is a block diagram showing the phases of the microwave fields along the accelerating cavities 620*a*, 620*b* . . . 620*g* of linac 600 operating in the π-mode. In this embodiment, the coupling of the microwave power between accelerating cavities 620*a*, 620*b* . . . 620*g* is accomplished mainly through irises 617*a*, 617*b*, 617*c* . . . 617*f* and partially through the axial bore 640. Other design considerations such as high shunt impedance, may limit on how large axial bore 640 can be to maintain stable and efficient operation.

In some industrial and medical applications, the electron beam of linac 600 can be directed at a suitable target such as tungsten or gold to generate x-rays. These x-rays are useful, for example, for the inspection of cargo, or for the imaging and/or treatment of medical diseases and conditions such as cancers.

As illustrated by FIG. 5B, linac 600 can operate at multiple frequency modes depending on the frequency of the microwave fields fed from the microwave source. For example, the operating frequency of linac 600 can be selected to match the frequency corresponding to the π-mode, i.e., the microwave fields should at approximately 3.01 GHz (3010 MHz). The corresponding wavelength of microwave fields operating at 3 GHz is approximately 10 cm. Accordingly, the accelerating cavities 620*a*, 620*b* . . . 620*g* should be approximately 5 cm in length in order to ensure synchrony between the electrons being accelerated and the electromagnetic fields.

Note that accelerated electrons travel at a speed very close to the speed of light once these electrons attain energies higher than 1 MeV. Hence, the cavity length of the first one or two linac cavities, e.g., cavities 620*a*, 620*b*, at the up-stream of the linac, where the electrons have not attained enough energy yet to be relativistic (close to the speed of light), can be between 2 and 5 cm depending on the energy of the electrons, emitted by the electron gun, as the electrons enter linac 600. Detailed dimensions of linac configuration can be obtained using computer simulation programs such as "Maxwell's Equations by the Finite Integration Algorithm"(MAFIA) available from "Computer Simulation Technology (CTS), or "ANALYST" available from Simulation Technology and Applied Research, Inc.

Figure 7B:
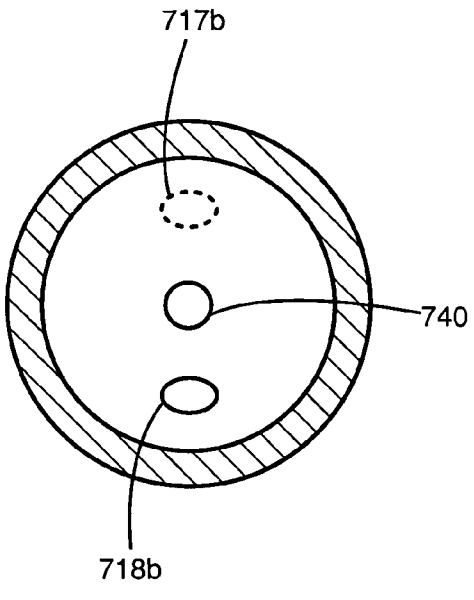
FIGS. 7A, 7B and 8A, 8B show two additional embodiments of lower-energy π-mode linear accelerators.
Figure 7A:
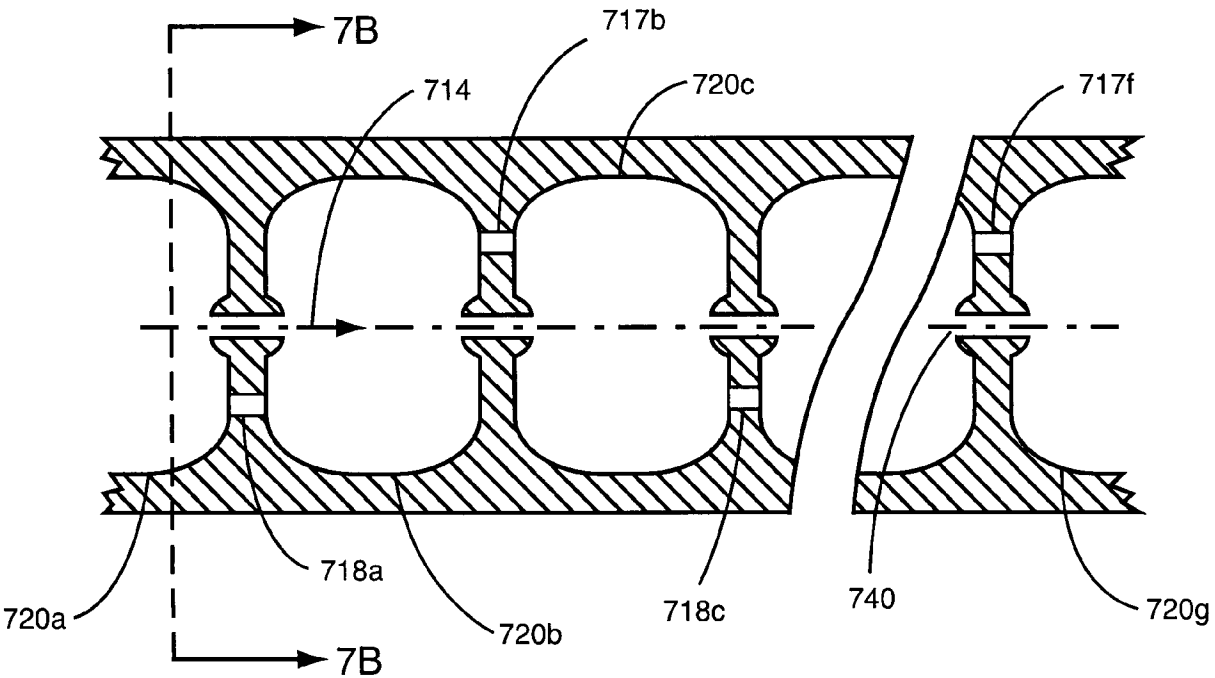

Another embodiment of a lower-energy π-mode linac 700 useful for industrial and medical application is depicted in FIGS. 7A and 7B. A set of staggered coupling irises 718*a*, 717*b*, 718*c* . . . 717*f* provides improved coupling for the microwave power between accelerating cavities 720*a*, 720*b*, 720*c* . . . 720*g*, thereby allowing most of the microwave power to bypass axial bore 740. For example, adjacent accelerating cavities 720*a*, 720*b* are coupled to each other via iris 718*a*, while adjacent accelerating cavities 720*b*, 720*c* are coupled to each other via iris 717*b*. Hence, irises 718*a*, 717*b*, 718*c* . . . 717*f* facilitate the overall flow of the microwave power thereby enabling linac 700 to operate efficiently in the π-mode. Note that the microwave fields phases for linac 700 are similar to that shown in FIG. 6C for linac 600. Accordingly, by operating in the π-mode, the total number of cavities in linac 700 is advantageously reduced to about one-half of that needed in a conventional bi-periodic linac of equivalent power.

Figure 8B:
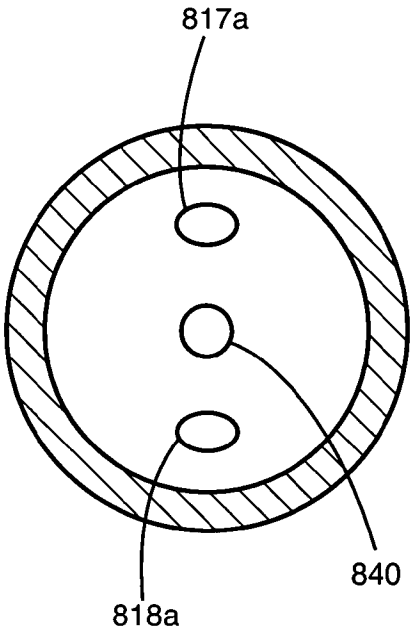
Figure 8A:
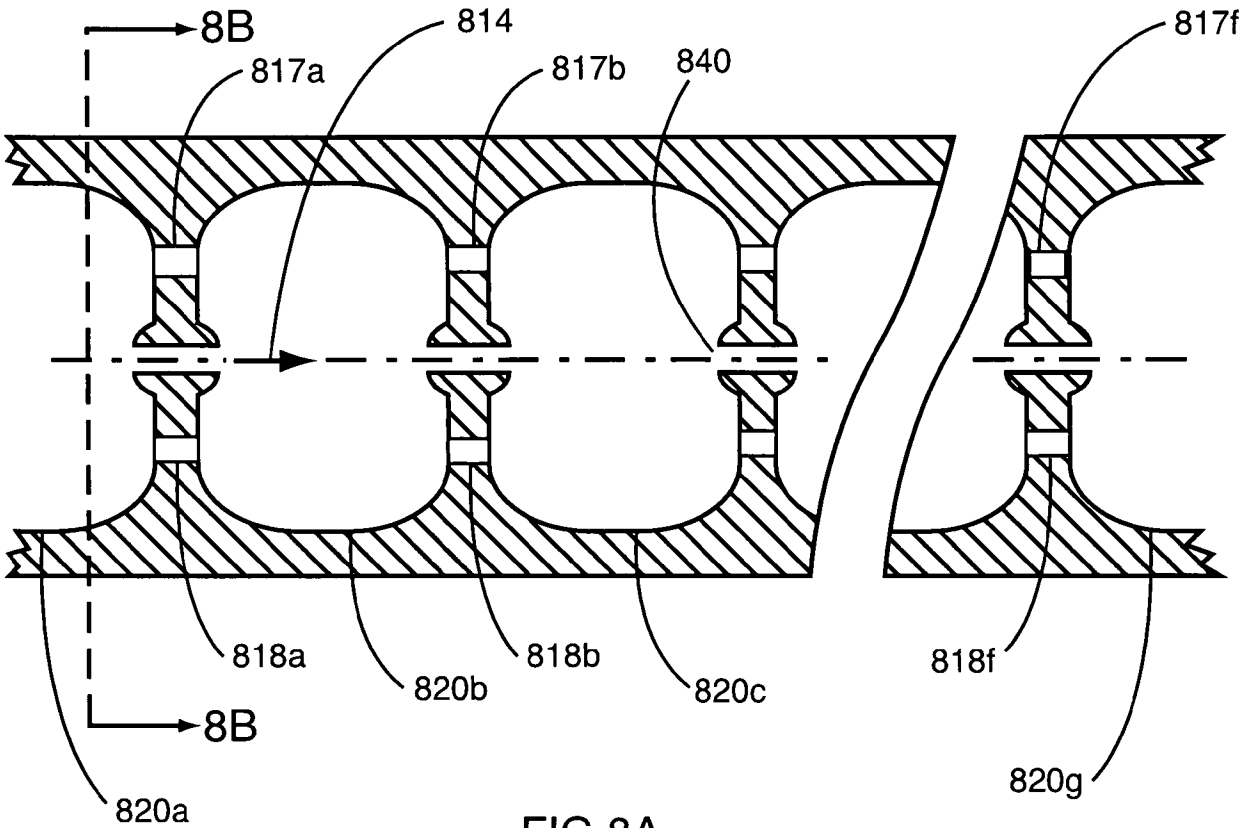

Yet another embodiment of lower-energy π-mode linac 800 useful for industrial and medical application is depicted in FIGS. 8A and 8B. A set of paired coupling irises 817*a* & 818*a*, 817*b* & 818*b* . . . 817*f* & 818*f* provides improved coupling for the microwave power between accelerating cavities 820*a*, 820*b*, 820*c* . . . 820*g*, thereby allowing most of the microwave power to bypass axial bore 840. For example, adjacent accelerating cavities 820*a*, 820*b* are coupled to each other via a pair of irises 817*a*, 818*a*. Irises 817*a* & 818*a*, 817*b* & 818*b* . . . 817*f* & 818*f* greatly facilitate the overall flow of the microwave power thereby enabling linac 800 to operate more efficiently in the π-mode. The microwave fields phases for linac 800 are also similar to that shown in FIG. 6C for linac 600. As discussed above, the total number of cavities in π-mode linac 800 needs to be about one-half of that required in an equivalent conventional bi-periodic linac.

In some industrial and medical applications, higher-energy SW linacs are needed to produce electron beams with output energies greater than 10 MeV. Such higher-energy linacs would require a relative large number of accelerating cavities, and it may not be feasible to operate these higher-energy linacs in a stable π-mode because of insufficient frequency mode spacing as illustrated by FIG. 2. Conventionally, the solution for designing stable higher-energy linacs is to incorporate auxiliary cavities as described above for bi-periodic linacs 300, 400.

Figure 9A:
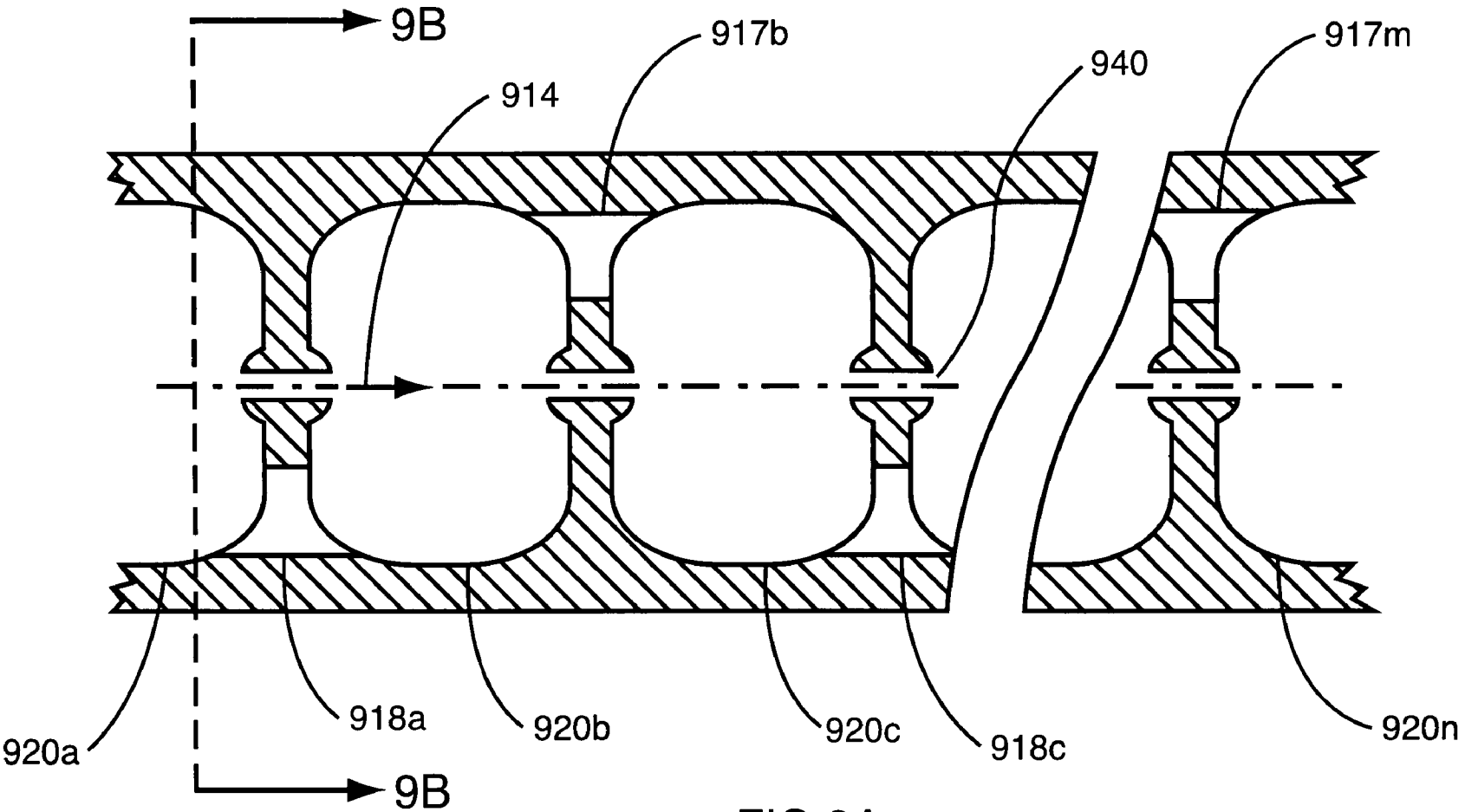
FIGS. 9A and 9B illustrate an embodiment of a higher-energy π/2-mode linear accelerator with accelerating cavities coupled to each other by resonating irises.
Figure 9B:
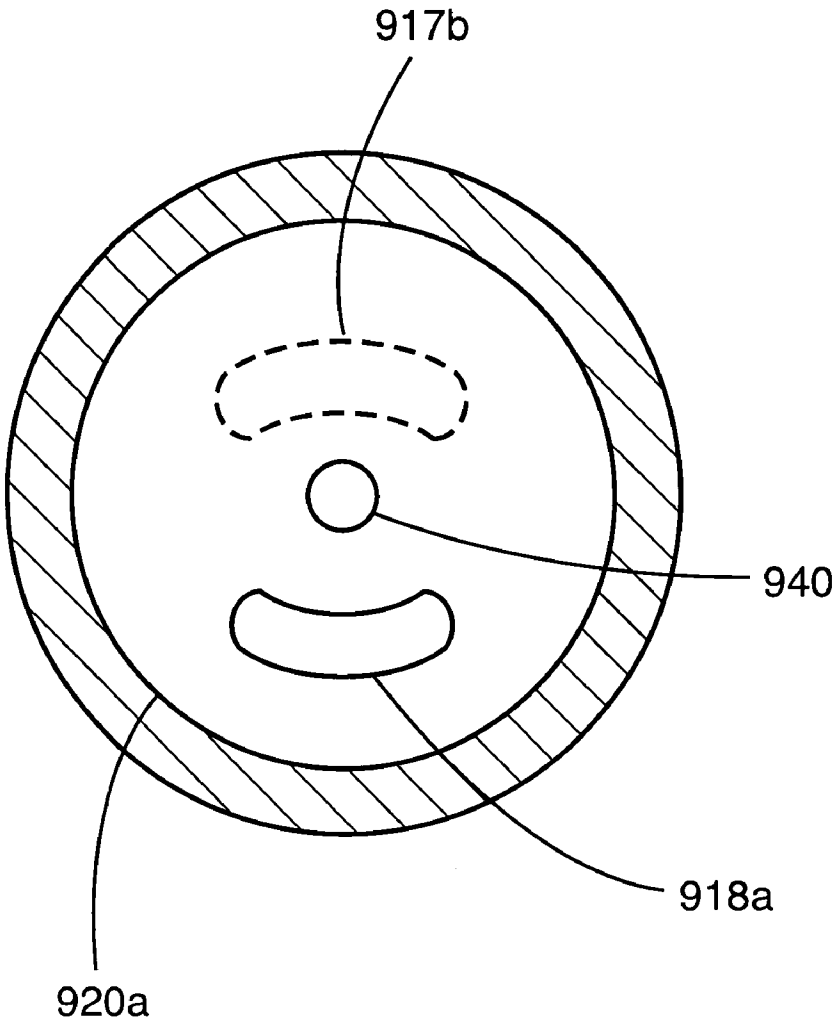

In contrast, FIGS. 9A and 9B illustrate an exemplary linac 900 with a relatively large number of accelerating cavities 920*a*, 920*b*, 920*c* . . . 920*n* capable of generating output energies substantially greater than 10 MeV, and without the need for auxiliary cavities. Accelerating cavities 920*a*, 920*b*, 920*c* . . . 920*n* of linac 900 are coupled to each other by a set of staggered coupling irises 918*a*, 917*b* . . . 917*m*. For example, adjacent accelerating cavities 920*a*, 920*b* are coupled to each other via an iris 918*a*.

Figure 9C:
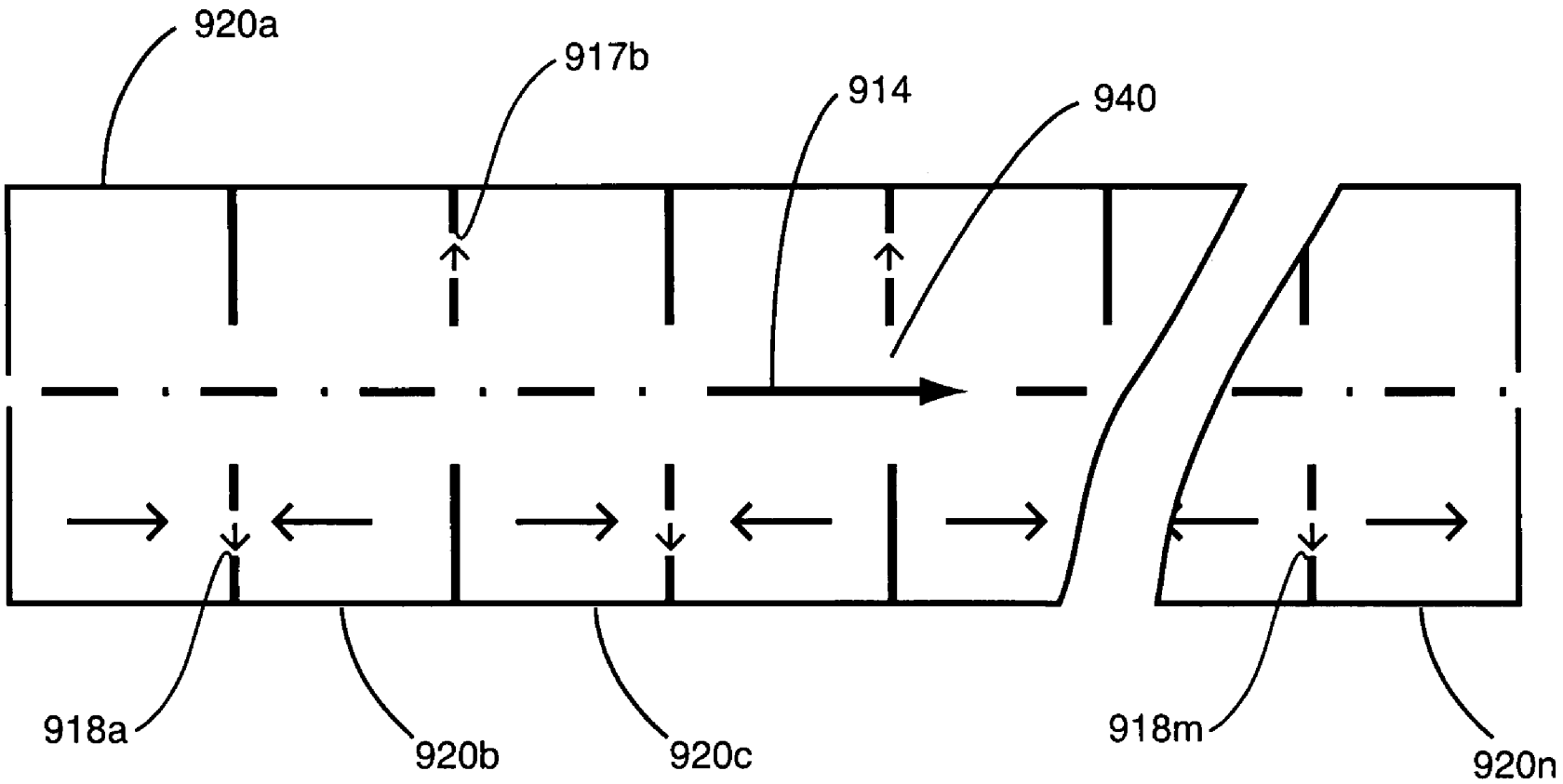
FIG. 9C is a microwave phase diagram for a linear accelerator operating in the relatively more stable π/2-mode without the need for auxiliary cavities.

In accordance with the present invention, in addition to coupling the microwave fields between accelerating cavities, coupling irises 918*a*, 917*b* . . . 917*m* also function as microwave resonators thereby enabling linac 900 to operate in the relatively more stable π/2-mode, as shown in the microwave phase diagram of FIG. 9C. In other words, coupling irises 918*a*, 917*b* . . . 917*m* also advantageously function as resonant irises. Thus, resonant irises 918*a*, 917*b* . . . 917*m* enable linac 900 to achieve bi-periodic performance without the need for a corresponding set of auxiliary cavities, thereby reducing the total number of cavities by half the number of that needed for a conventional bi-periodic linac with a similar energy output.

To achieve efficient resonating microwave fields, the dimensions of resonant irises 918*a*, 917*b* . . . 917*m* can be mathematical functions of operating microwave frequency of linac 900. In this embodiment, the length of resonant irises 918*a*, 917*b* . . . 917*m* is a function of the microwave wavelength such as one half or one quarter of the wavelength of the operating microwave. For example, for operation at 3 GHz, the iris length is approximately 5 cm. The width and the thickness of resonant irises 918*a*, 917*b* . . . 917*m* are design parameters that can be selected to optimize the efficiency of linac 900. Hence, linac 900 is capable of operating in a stable bi-periodic manner without the need for auxiliary cavities. By operating in this bi-periodic manner, i.e., in the $\pi/2$-mode, linac 900 is able to generate upwards of about 25 MeV, while operating in a stable manner and permitting relaxation of manufacturing tolerances.

Figure 9D:
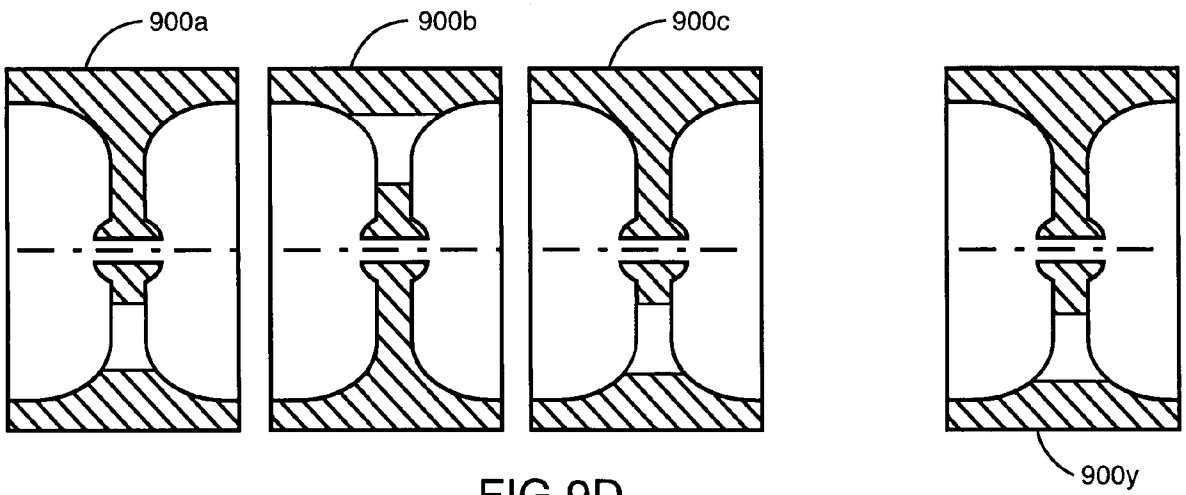
FIGS. 9D and 9E depict the pre-assembly and the post-assembly, respectively, of the linear accelerator of FIG. 9A.
Figure 9E:
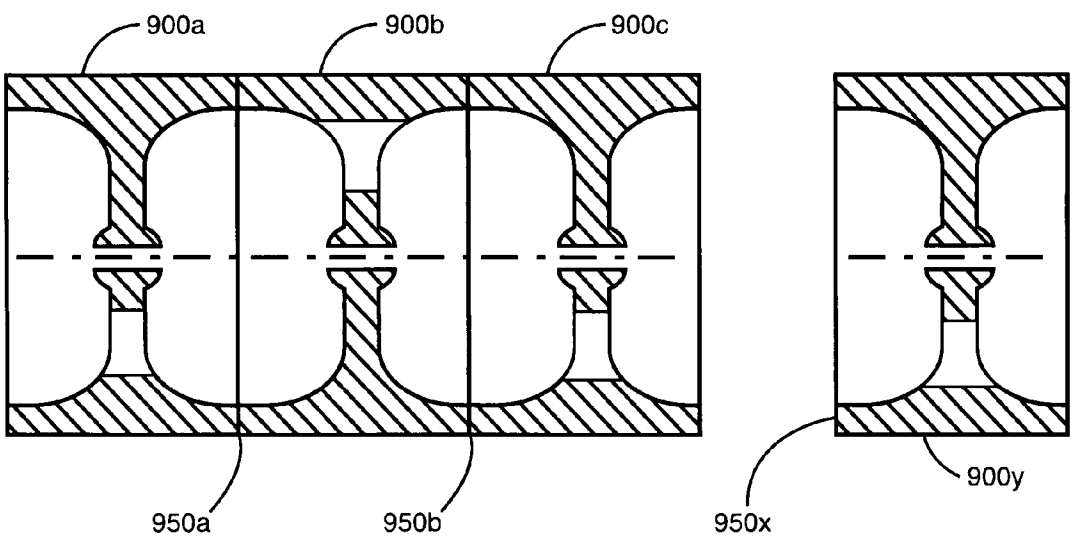

By eliminating the need for auxiliary cavities, linacs 600, 700, 800 and 900 advantageously maintain a simplified structure and a cylindrical cross-sectional shape. FIGS. 9D and 9E depict the pre-assembly and the post-assembly, respectively, of exemplary linac 900. While linacs 600, 700, 800 and 900 can be assembled using the brazing process described above, the cylindrical cross-sectional shape of linacs 600, 700, 800 and 900 makes assembly easier, enabling linacs 600, 700, 800 and 900 to be manufactured using a more cost effective diffusion bonding described below for exemplary linac 900.

First, the constituent sub-assembly components 900*a*, 900*b*, 900*c* . . . 900*y* are machined to the nominal design dimensions. The joining surfaces of components 900*a*, 900*b*, 900*c* . . . 900*y* are also machined to the required flatness and surface roughness. In linac 900, joints 950*a*, 950*b* . . . 950*x* should be vacuum tight to ensure linac vacuum integrity. Joints 950*a*, 950*b* . . . 950*x* are also required to provide the microwave continuity for the inner cavity walls of linac 900 hosting the microwave currents associated with the electromagnetic fields. In diffusion bonding, the stacked assembly for linac 900, comprising of components 900*a*, 900*b*, 900*c* . . . 900*y*, is placed in a furnace which provides the heat for bonding joints 950*a*, 950*b* . . . 950*x* at a temperature close to, but lower than, the melting point of the linac material, e.g., copper. During the heating process, the stacked assembly for linac 900 is kept under the required pressure for proper bonding.

Since diffusion bonding does not involve the melting of a brazing alloy, the problem of having foreign material deposited inside the cavity walls of linacs 600, 700, 800 and 900 has now been eliminated. For this reason, post assembly tuning of the individual accelerating cavities of linacs 600, 700, 800 and 900 should no longer be needed. Hence, the simpler and more cost effective diffusion bonding process can replace the more expensive brazing and tuning steps. This result in advantageous savings associated with cost of material, manufacturing time, and capital and operating cost of multiple brazing furnaces. In addition, this cylindrical cross-sectional configuration allows for potential robotic stacking of cavities and automated assembly of linacs 600, 700, 800 and 900.

The cylindrical cross-sectional profile of linacs 600, 700, 800, 900 also advantageously allows for the easy placement of magnetic coils around linacs 500, 700, 800, 900. This is because for some applications, linacs 600, 700, 800, 900 may require magnetic coils for beam focusing and/or beam steering as to better control of the beam spot size and beam position. A well-controlled electron beam colliding on the x-ray target will result in more accurate x-rays.

Many modifications to linacs 600, 700, 800, 900 are also possible. For example, instead of operating at the $\pi$-mode, the exemplary 7 cavity linac 600 can operate at a mode adjacent to the $\pi$-mode such as the 6/7 $\pi$-mode.

Although the above description uses exemplary microwave frequencies, exemplary linac energy levels, exemplary linac dimensions, and exemplary industrial and medical applications, these examples are not intended to limit the scope of the invention. For example, while assembly techniques such as brazing and diffusion bonding has been described in this application, it is possible to use other assembly techniques known to one skilled in the art.

While this invention has been described in terms of several preferred embodiments, there are alterations, modifications, permutations, and substitute equivalents, which fall within the scope of this invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A method for generating an electron beam, useful in association with a standing-wave linear accelerator having a plurality of accelerating cavities and without any auxiliary cavities, the method comprising:

generating an electron beam; and accelerating the electron beam along a plurality of accelerating cavities, wherein at least two adjacent accelerating cavities of the plurality of accelerating cavities are coupled together by at least one resonant iris, wherein the electron beam is accelerated by applying electromagnetic fields generated by a microwave source, and wherein the electromagnetic fields resonate through the plurality of accelerating cavities and the at least one resonant iris.

2. The method of claim 1, further comprising focusing the electron beam for better size control of the electron beam.

3. The method of claim 1, further comprising steering the electron beam for better position control of the electron beam.

4. The method of claim 1 wherein at least one dimension of the at least one resonant iris is a mathematical function of the frequency of the electromagnetic field.

5. A standing-wave linear accelerator without any auxiliary cavities, the linear accelerator comprising:

an electron gun configured to generate an electron beam; and a plurality of accelerating cavities configured to accelerate the electron beam by applying electromagnetic fields generated by a microwave source, wherein the electromagnetic fields resonate through the plurality of accelerating cavities, and wherein at least two adjacent accelerating cavities of the plurality of accelerating cavities are coupled together by at least one resonant iris which functions as a resonator for the electromagnetic fields.

6. The linear accelerator of claim 5, wherein at least one dimension of the at least one resonant iris is a mathematical function of the frequency of the electromagnetic fields generated by a microwave source.

7. The linear accelerator of claim 6 wherein the at least one dimension is a length of the at least one resonant iris, and wherein the length of the at least one resonant iris is one half wavelength or one quarter wavelength of the electromagnetic field.

8. The linear accelerator of claim 5, further comprising magnetic coils configured to focus and steer the electron beam.

9. The linear accelerator of claim 5, wherein assembly of the linear accelerator includes a diffusion bonding process.

10. The linear accelerator of claim 5 further comprising a second resonant iris.

11. The linear accelerator of claim 10 wherein the second resonant iris couples the at least two adjacent accelerating cavities.

12. The linear accelerator of claim 5 wherein the plurality of accelerating cavities includes a third cavity adjacent to a second cavity of the at least two adjacent cavities, and wherein a second resonant iris couples the third cavity and the second cavity.

13. The linear accelerator of claim 12 wherein the third cavity and the second cavity are staggered relative to an axis of the electron beam.

14. The linear accelerator of claim 5 wherein the frequency of the electromagnetic fields is selected so that the linear accelerator is operating at a $\pi/2$-mode or a mode close to the $\pi/2$-mode.

15. The linear accelerator of claim 5 wherein the frequency of the electromagnetic fields is selected so that the linear accelerator is operating at a $\pi$-mode or a mode close to the $\pi$-mode.

16. An x-ray machine comprising:

a linear accelerator having an electron gun configured to generate an electron beam and a plurality of accelerating cavities configured to accelerate the electron beam by applying electromagnetic fields generated by a microwave source, wherein the electromagnetic fields resonate through the plurality of accelerating cavities, and wherein at least two adjacent accelerating cavities of the plurality of accelerating cavities are coupled together by at least one resonant iris which functions as a resonator for the electromagnetic fields; and a target configured to produce x-rays when the electron beam collides with the target.

17. The x-ray machine of claim 16, wherein at least one dimension of the at least one resonant iris is a mathematical function of the frequency of the electromagnetic fields generated by a microwave source.

18. The X-ray machine of claim 17 wherein the at least one dimension is a length of the at least one resonant iris, and wherein the length of the at least one resonant iris is one half wavelength or one quaffer wavelength of the electromagnetic field.

19. The x-ray machine of claim 16, wherein the linear accelerator further comprises a magnetic coil configured to focus and steer the electron beam toward the target.

20. The x-ray machine of claim 16, wherein assembly of the linear accelerator includes a diffusion bonding process.

* * * * *